US008553504B2

(12) United States Patent
Lindahl et al.

(10) Patent No.: US 8,553,504 B2
(45) Date of Patent: Oct. 8, 2013

(54) CROSSFADING OF AUDIO SIGNALS

(75) Inventors: Aram Lindahl, Menlo Park, CA (US); Bryan James, Menlo Park, CA (US)

(73) Assignee: Apple Inc., Cupertino, CA (US)

( * ) Notice: Subject to any disclaimer, the term of this patent is extended or adjusted under 35 U.S.C. 154(b) by 663 days.

(21) Appl. No.: 12/330,311

(22) Filed: Dec. 8, 2008

(65) Prior Publication Data

US 2010/0142730 A1 Jun. 10, 2010

(51) Int. Cl.
*H04R 29/00* (2006.01)
*G10H 1/46* (2006.01)

(52) U.S. Cl.
USPC ..... 369/3; 369/2; 381/106; 381/107; 381/119

(58) Field of Classification Search
USPC ..... 381/119, 104–109; 369/2–4; 84/625, 84/660; 700/94
See application file for complete search history.

(56) References Cited

U.S. PATENT DOCUMENTS

| | | | | |
|---|---|---|---|---|
| 4,947,440 | A * | 8/1990 | Bateman et al. | 381/107 |
| 6,259,793 | B1 * | 7/2001 | Washio et al. | 381/119 |
| 6,534,700 | B2 * | 3/2003 | Cliff | 84/603 |
| 6,889,193 | B2 * | 5/2005 | McLean | 704/500 |
| 7,396,992 | B2 * | 7/2008 | Tamura et al. | 84/625 |
| 7,398,207 | B2 * | 7/2008 | Riedl | 704/225 |
| 2004/0264715 | A1 * | 12/2004 | Lu et al. | 381/119 |
| 2005/0201572 | A1 | 9/2005 | Lindahl et al. | |
| 2006/0067535 | A1 | 3/2006 | Culbert et al. | |
| 2006/0067536 | A1 | 3/2006 | Culbert et al. | |
| 2006/0153040 | A1 | 7/2006 | Girish et al. | |
| 2006/0221788 | A1 | 10/2006 | Lindahl et al. | |
| 2006/0274905 | A1 | 12/2006 | Lindahl et al. | |
| 2008/0075296 | A1 | 3/2008 | Lindahl et al. | |
| 2008/0190267 | A1 * | 8/2008 | Rechsteiner et al. | 84/609 |
| 2008/0192959 | A1 * | 8/2008 | Lee | 381/107 |
| 2008/0289479 | A1 * | 11/2008 | Matsuhashi et al. | 84/604 |

FOREIGN PATENT DOCUMENTS

| | | |
|---|---|---|
| EP | 1842201 | 10/2007 |
| EP | 1938602 | 7/2008 |
| WO | WO2007081526 | 7/2007 |

OTHER PUBLICATIONS

U.S. Appl. No. 12/205,649, filed Sep. 5, 2008, Aram Lindahl et al.

* cited by examiner

*Primary Examiner* — Steven J Fulk
*Assistant Examiner* — Eric Ward
(74) *Attorney, Agent, or Firm* — Blakely, Sokoloff, Taylor & Zafman LLP

(57) ABSTRACT

A technique is disclosed to implement crossfading of audio tracks. In one embodiment, the function describing the fade out of the ending audio track and/or the slope describing the fade in of the beginning audio track may be altered to increase the perceptible overlap of the two tracks. In another embodiment, the duration of the fade out and/or of the fade in may be altered to increase the perceptible overlap of the two tracks. In other embodiments, one or both of the function and/or duration of the fade out and/or fade in effect may be altered to improve the perceptibility of the overlap or the audio tracks.

24 Claims, 4 Drawing Sheets

CROSSFADING OF AUDIO SIGNALS

BACKGROUND OF THE INVENTION

1. Field of fhe Invention

The present invention relates generally to audio playback in electronic devices, and more particularly to crossfading during audio playback.

2. Description of the Related Art

This section is intended to introduce the reader to various aspects of art that may be related to various aspects of the present invention, which are described and/or claimed below. This discussion is believed to be helpful in providing the reader with background information to facilitate a better understanding of the various aspects of the present invention. Accordingly, it should be understood that these statements are to be read in this light, and not as admissions of prior art.

Electronic devices are widely used for a variety of tasks. Among the functions provided by electronic devices, audio playback, such as playback of music, audiobooks, podcasts, lectures, etc., is one of the most widely used. During playback, it may be desirable to have an audio stream, i.e., audio track, "fade" out while another audio stream fades in. Such a technique is referred to as "crossfading." For example, the end of a first audio stream may be slowly faded out (e.g., by decreasing the playback volume of the track), and the beginning of a second audio stream may be slowly faded in (e.g., by increasing the playback volume of the track).

However, depending on the characteristics of the audio tracks, the crossfade operation may not be perceptible or may be barely perceptible to a listener. For example, if the ending audio stream fading out has a lower volume, and the beginning of the audio stream fading in has a higher volume, a listener may not be able to perceive the fading out of the ending audio stream over the fading in of the beginning audio stream when a typical crossfade is performed.

SUMMARY

Certain aspects commensurate in scope with the originally claimed invention are set forth below. It should be understood that these aspects are presented merely to provide the reader with a brief summary of certain forms of the invention might take and that these aspects are not intended to limit the scope of the invention. Indeed, the invention may encompass a variety of aspects that may not be set forth below.

In one embodiment, an electronic device is provided that includes an audio processor capable of analyzing the characteristics of audio streams. The audio processor may analyze the amplitude characteristics of the end of an ending audio stream and the start of a beginning audio stream. Based on the analysis, one or more parameters of the crossfade may be modified so that the crossfade can be easily perceived by a listener. For example, in certain embodiments, duration and/or shape of fade out and fade in curves for the respective finishing and beginning audio streams may be adjusted based on their amplitude characteristics.

In one implementation, the electronic device may include an audio memory component capable of storing data about the characteristics of various audio streams that may be used to implement a perceptible crossfade of two audio streams. Such data may be encoded in the audio files of the audio streams themselves or stored in a separate table. Additionally, data regarding the characteristics of the audio streams may be generated by the audio processor when it analyzes the audio streams, and may be stored in the memory component to be accessed prior to future crossfades, or may be used on-the-fly in a pending crossfade operation. Thus, the audio processor may obtain the data for performing modified crossfade operations directly from a suitable memory component in the electronic device, or from analyses of the audio streams performed prior to the crossfade operation.

BRIEF DESCRIPTION OF THE DRAWINGS

Advantages of the invention may become apparent upon reading the following detailed description and upon reference to the drawings in which.

DETAILED DESCRIPTION OF SPECIFIC EMBODIMENTS

One or more specific embodiments of the present invention will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Figure 1:
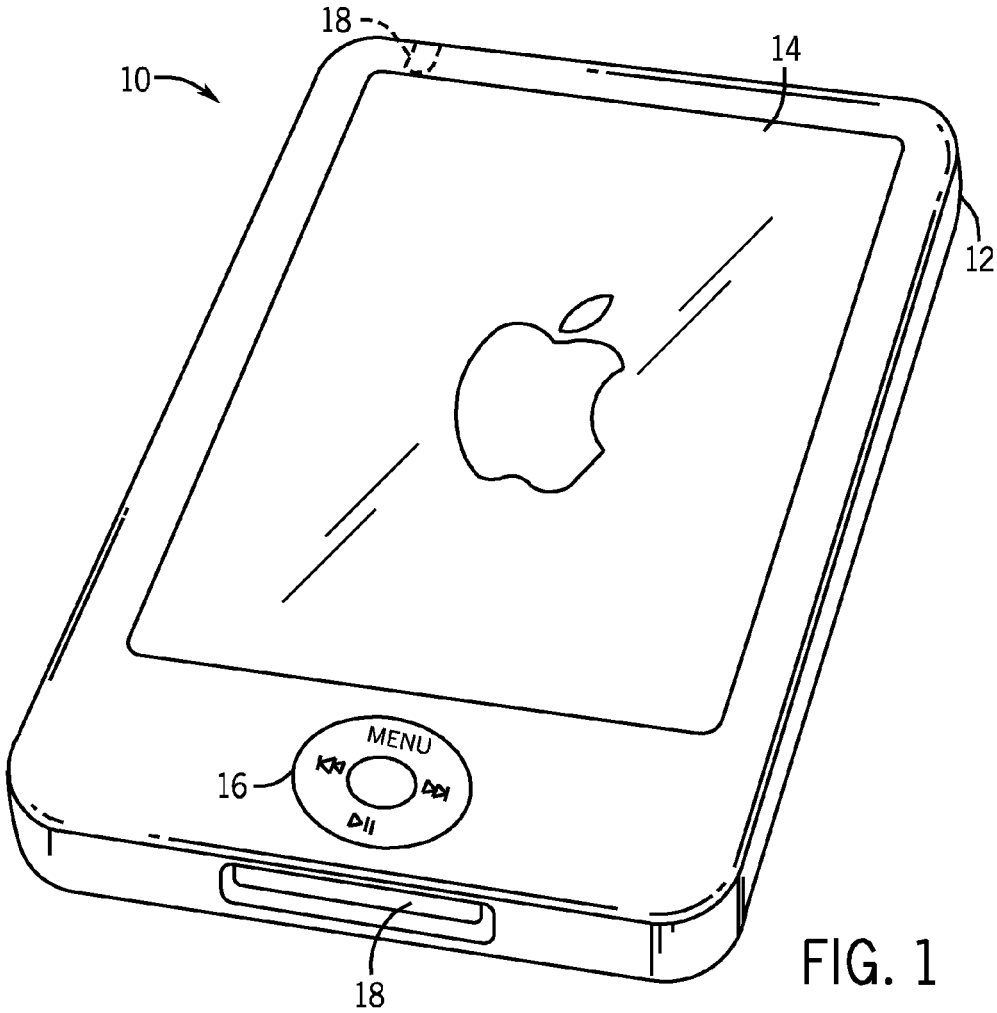
FIG. 1 is a perspective view illustrating an electronic device, such as a portable media player, in accordance with one embodiment of the present invention.

Turning now to the figures, FIG. 1 depicts an electronic device 10 in accordance with one embodiment of the present invention. In some embodiments, the electronic device 10 may be a media player for playing music and/or video, a cellular phone, a personal data organizer, or any combination thereof. Thus, the electronic device 10 may be a unified device providing any one of or a combination of the functionality of a media player, a cellular phone, a personal data organizer, and so forth. In addition, the electronic device 10 may allow a user to connect to and communicate through the Internet or through other networks, such as local or wide area networks. For example, the electronic device 10 may allow a user to communicate using e-mail, text messaging, instant messaging, or using other forms of electronic communication. By way of example, the electronic device 10 may be a model of an iPod® or iPhone® available from Apple Inc.

In certain embodiments the electronic device 10 may be powered by a rechargeable or replaceable battery. Such battery-powered implementations may be highly portable, allowing a user to carry the electronic device 10 while traveling, working, exercising, and so forth. In this manner, a user of the electronic device 10, depending on the functionalities provided by the electronic device 10, may listen to music, play games or video, record video or take pictures, place and take telephone calls, communicate with others, control other devices (e.g., the device 10 may include remote control and/or Bluetooth functionality, for example), and so forth while moving freely with the device 10. In addition, in certain embodiments the device 10 may be sized such that it fits relatively easily into a pocket or hand of the user. In such embodiments, the device 10 is relatively small and easily handled and utilized by its user and thus may be taken practically anywhere the user travels. While the present discussion and examples described herein generally reference an electronic device 10 which is portable, such as that depicted in FIG. 1, it should be understood that the techniques discussed herein may be applicable to any electronic device having audio playback capabilities, including desktop or laptop computers, regardless of the portability of the device. By way of example, the techniques discussed herein may be performed on a computer having the iTunes® application, available from Apple, Inc., or any other media player.

In the depicted embodiment, the electronic device 10 includes an enclosure 12, a display 14, user input structures 16, and input/output ports 18. The enclosure 12 may be formed from plastic, metal, composite materials, or other suitable materials or any combination thereof. The enclosure 12 may protect the interior components of the electronic device 10 from physical damage, and may also shield the interior components from electromagnetic interference (EMI).

The display 14 may be a liquid crystal display (LCD), a light emitting diode (LED) based display, an organic light emitting diode (OLED) based display, or other suitable display. Additionally, in one embodiment the display 14 may be a touch screen through which a user may interact with the user interface.

In one embodiment, one or more of the user input structures 16 are configured to control the device 10, such as by controlling a mode of operation, an output level, an output type, etc. For instance, the user input structures 16 may include a button to turn the device 10 on or off. In general, embodiments of the electronic device 10 may include any number of user input structures 16, including buttons, switches, a control pad, keys, knobs, a scroll wheel, or any other suitable input structures. The input structures 16 may be used to internet with a user interface displayed on the device 10 to control functions of the device 10 or of other devices connected to or used by the device 10. For example, the user input structures 16 may allow a user to navigate a displayed user interface or to return such a displayed user interface to a default or home screen.

The electronic device 10 may also include various input and/or output ports 18 to allow connection of additional devices. For example, a port 18 may be a headphone or audio jack that provides for connection of headphones or speakers. Additionally, a port 18 may have both input/output capabilities to provide for connection of a headset (e.g. a headphone and microphone combination). Embodiments of the present invention may include any number of input and/or output ports, including headphone and headset jacks, universal serial bus (USB) ports, Firewire or IEEE-1394 ports, and AC and/or DC power connectors. Further, the device 10 may use the input and output ports to connect to and send or receive data with any other device, such as other portable electronic devices, personal computers, printers, etc. For example, in one embodiment the electronic device 10 may connect to a personal computer via a USB, Firewire, or IEEE-1394 connection to send and receive data files, such as media files.

Figure 2:
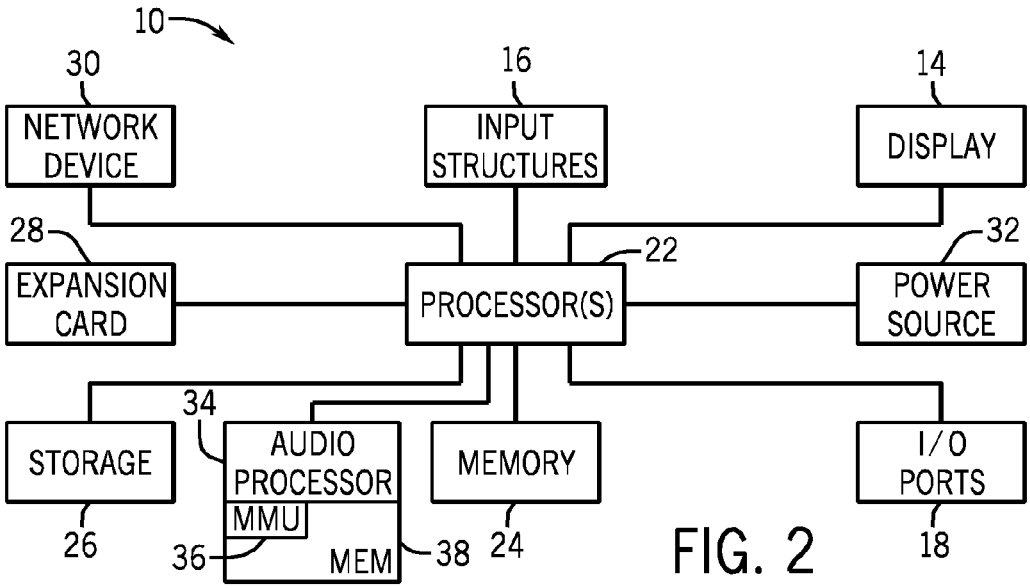
FIG. 2 is a simplified block diagram of components of the portable media player of FIG. 1 in accordance with one embodiment of the present invention.

Turning now to FIG. 2, a block diagram of components of an illustrative electronic device 10 is shown. The block diagram includes the display 14 and I/O ports 18 discussed above. In addition, the block diagram illustrates the input structure 16, one or more processors 22, a memory 24, storage 26, card interface(s) 28, networking device 30, and power source 32.

As discussed herein, in certain embodiments, a user interface may be implemented on the device 10. The user interface may be a textual user interface, a graphical user interface (GUI), or any combination thereof, and may include various layers, windows, screens, templates, elements or other components that may be displayed in all or some of the areas of the display 14.

The user interface may, in certain embodiments, allow a user to interface with displayed interface elements via the one or more user input structures 16 and/or via a touch sensitive implementation of the display 14. In such embodiments, the user interface provides interactive functionality, allowing a user to select, by touch screen or other input structure, from among options displayed on the display 14. Thus the user can operate the device 10 by appropriate interaction with the user interface.

The processor(s) 22 may provide the processing capability required to execute the operating system, programs, user interface, and any other functions of the device 10. The processor(s) 22 may include one or more microprocessors, such as one or more "general-purpose" microprocessors, a combination of general and special purpose microprocessors, and/or ASICS. For example, the processor(s) 22 may include one or more reduced instruction set (RISC) processors, such as a RISC processor manufactured by Samsung, as well as graphics processors, video processors, and/or related chip sets.

Embodiments of the electronic device 10 may also include a memory 24. The memory 24 may include a volatile memory, such as RAM, and/or a non-volatile memory, such as ROM. The memory 24 may store a variety of information and may be used for a variety of purposes. For example, the memory 24 may store the firmware for the device 10, such as an operating system for the device 10, and/or any other programs or executable code necessary for the device 10 to function. In addition, the memory 24 may be used for buffering or caching during operation of the device 10.

The device 10 in FIG. 2 may also include non-volatile storage 26, such as ROM, flash memory, a hard drive, any other suitable optical, magnetic, or solid-state storage medium, or a combination thereof. The storage 26 may store data files such as media (e.g., music and video files), software (e.g., for implementing functions on device 10), preference information (e.g., media playback preferences), lifestyle information (e.g., food preferences), exercise information (e.g., information obtained by exercise monitoring equipment), transaction information (e.g., information such as credit card information), wireless connection information (e.g., information that may enable media device to establish a wireless connection such as a telephone connection), subscription information (e.g., information that maintains a record of podcasts or television shows or other media a user subscribes to), content information (e.g., telephone numbers or email addresses), and any other suitable data.

The embodiment in FIG. 2 also includes one or more card slots 28. The card slots 28 may receive expansion cards that may be used to add functionality to the device 10, such as additional memory, I/O functionality, or networking capability. The expansion card may connect to the device 10 through suitable connector and may be accessed internally or externally to the enclosure 12. For example, in one embodiment the card may be a flash memory card, such as a SecureDigital (SD) card, mini- or microSD, CompactFlash card, Multimedia card (MMC), etc. Additionally, in some embodiments a card slot 28 may receive a Subscriber Identity Module (SIM) card, for use with an embodiment of the electronic device 10 that provides mobile phone capability.

The device 10 depicted in FIG. 2 also includes a network device 30, such as a network controller or a network interface card (NIC). In one embodiment, the network device 30 may be a wireless NIC providing wireless connectivity over 802.11 standard or any other suitable wireless networking standard. The network device 30 may allow the device 10 to communicate over a network, such as a LAN, WAN, MAN, or the Internet. Further, the device 10 may connect to and send or receive data with any device on the network, such as portable electronic devices, personal computers, printers, etc. For example, in one embodiment, the electronic device 10 may connect to a personal computer via the network device 30 to send and receive data files, such as media files. Alternatively, in some embodiments the electronic device may not include a network device 30. In such an embodiment, a NIC may be added into card slot 28 to provide similar networking capability as described above.

The device 10 may also include or be connected to a power source 32. In one embodiment, the power source 32 may be a battery, such as a Li-Ion battery. In such embodiments, the battery may be rechargeable, removable, and/or attached to other components of the device 10. Additionally, in certain embodiments the power source 32 may be an external power source, such as a connection to AC power, and the device 10 may be connected to the power source 32 via an I/O port 18.

To process and decode audio data, the device 10 may include an audio processor 34. The audio processor 34 may perform functions such as decoding audio data encoded in a particular format. The audio processor 34 may also perform other functions such as crossfading audio streams and/or analyzing and categorizing audio stream characteristics which may be used for crossfading operations, as will be described later. In some embodiments, the audio processor 34 may include a memory management unit 36 and a dedicated memory 38, i.e., memory only accessible for use by the audio processor 34. The memory 38 may include any suitable volatile or non-volatile memory, and may be separate from, or a part of, the memory 24 used by the processor 22. In other embodiments, the audio processor 34 may share and use the memory 24 instead of or in addition to the dedicated audio memory 38. The audio processor 34 may include the memory management unit (MMU) 36 to manage access to the dedicated memory 38.

As described above, the storage 26 may store media files, such as audio files. In an embodiment, these media files may be compressed, encoded and/or encrypted in any suitable format. Encoding formats may include, but are not limited to, MP3, AAC, ACCPlus, Ogg Vorbis, MP4, MP3Pro, Windows Media Audio, or any suitable format. To playback media files, e.g., audio files, stored in the storage 26, the device 10 may decode the audio files before output to the I/O ports 18. Decoding may include decompressing, decrypting, or any other technique to convert data from one format to another format, and may be performed by the audio processor 34. After decoding, the data from the audio files may be streamed to memory 24, the I/O ports 18, or any other suitable component of the device 10 for playback. In some embodiments, the decoded audio data may be converted to analog signals prior to playback.

In the transition between two audio streams during playback, the device 10 may crossfade the audio streams, such as by "fading out" playback of the ending audio stream while simultaneously "fading in" playback of the beginning audio stream. Some implementations of the crossfade function may include customized fading out and fading in, depending on the characteristics of the audio streams to be crossfaded. For example, in one embodiment, prior to crossfading, the characteristics of the ending and beginning of audio streams may be analyzed to determine suitable crossfade effects. Analysis may be performed by the audio processor 34, or any other component of the device 10 suitable for performing such analysis. In some embodiments, data regarding audio stream characteristics may be stored in and/or accessed from either the memory 24 or the dedicated audio memory 38. Additionally, an audio file may include data concerning the characteristics of its decoded audio stream. Such data may be encoded in the audio file in the storage 26 and become accessible once the audio file is decoded by the audio processor 34.

Figure 3:
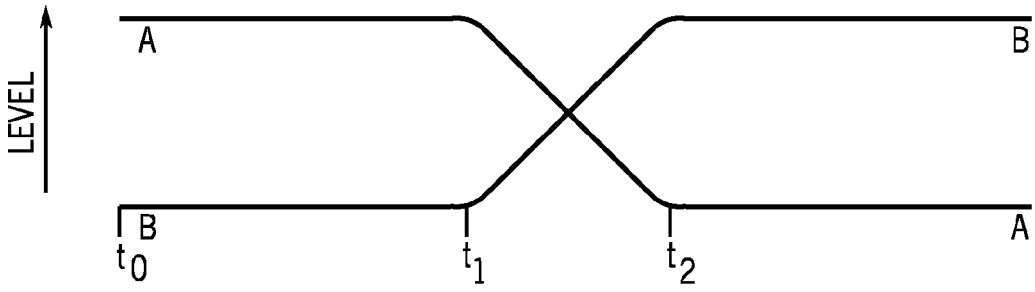
FIG. 3 is a graphical illustration representing a crossfade operation on two audio streams in accordance with an embodiment of the present invention.

FIG. 3 is a graphical illustration of the crossfading of two audio streams A and B. The "level" of each stream A and B is represented on the y-axis of FIG. 3. In an embodiment, the level may refer to the output volume, power level, or other parameter of the audio stream that corresponds to the level of sound a user would hear at the real-time output of the streams A and B. The combined streams of A and B are illustrated in FIG. 3 and may be referred to as the "mix" during playback.

The x-axis of FIG. 3 indicates the time elapsed during playback of the audio streams A and B. For example, at $t_0$, the first stream A is playing at the highest level, and stream B is playing at the lowest level or is not playing at all. The point to represents normal playback of stream A without any transition. At point $t_1$, the crossfading of streams A and B begins. Point $t_1$ may occur when stream A is reaching the end of the duration of the stream (for example, the last ten seconds of a song), and the device 10 can provide a fading transition between stream A and stream B to the user.

In the depicted implementation, at point $t_1$, stream B begins to increase in level and stream A begins to decrease in level. Between times $t_1$ and $t_2$, the level of stream A is reduced, while the level of stream B increases, crossfading the two streams A and B. At $t_2$, stream A has ended or is reduced to the lowest level, and stream B is at the highest level. As stream B nears the end of its duration, another stream may be added to the mix using the crossfading techniques described above, e.g., stream B is decreased in level and the next stream is increased in level.

A crossfade may sometimes be more difficult to perceive based on the characteristics of the stream fading out and/or the stream fading in. Using the depiction in FIG. 3 as an example, a typical crossfade function may be set to commence ($t_1$) ten seconds before the end of stream A and at the start of stream B and finish ($t_2$) at the end of stream A and ten seconds after the start of stream B. However, if the volume of stream A during last ten seconds of the track is already substantially low even without adjusting the level, then a reduction of level would make the fading out of stream A more difficult to perceive. Likewise, if the volume of stream B during the first ten seconds of the track is substantially low, then even an increase of level on stream B during the first ten seconds may not be perceived.

Modifying a crossfade depending on the characteristics of the ending and/or beginning audio streams may increase the perceptibility of the crossfade. Examples of different crossfade modifications are graphically depicted in FIGS. 4-9, where the solid lines 42 represent different or modified crossfade curves defined by the level of streams A and B at a certain time. In the depictions, the dotted segments 44 represent an example of an unmodified or default crossfade curve and provide a comparison with the modified crossfade curves, i.e., the solid lines 42. As used in the present application, the term "curves" is merely intended to graphically describe the fade in and/or fade out function applied to the audio streams. Therefore, as used herein, the term "curve" should be understood to relate to or describe the characteristics or shape of such a fade in or fade out function. Though these functions may be described as curves to facilitate visualization and explanation, such curves may include linear segments or elements.

Figure 4:
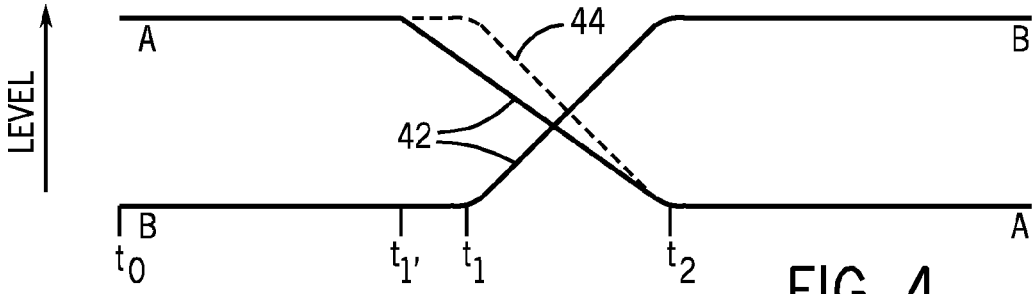
FIGS. 4-9 are graphical illustrations representing different crossfade operation implementations in accordance with an embodiment of the present invention.

As previously discussed, if the volume of an audio stream is low near the end or beginning of the track, then downward level adjustments on the already low output volume may be more difficult to perceive. FIG. 4 illustrates one technique of manipulating the crossfade duration which may increase the perceptibility of crossfading. At point $t_1'$ the crossfading of streams A and B begins when stream A begins to decrease in level. Point $t_1'$ may occur some time before $t_1$, where stream B begins to increase in level. At $t_2$, stream A has ended or is reduced to the lowest level, and stream B is at the highest level.

This adjustment of crossfade duration may increase perceptibility of the crossfade effect if, for example, the volume of stream A during the last ten seconds is low. While an unmodified crossfade may begin decreasing the level of stream A ten seconds before the end of the track, as depicted by the dotted segments 44, the modified crossfade depicted in FIG. 4 may begin decreasing the level of stream A earlier than ten seconds before the end of the track (e.g., 15 seconds or 20 seconds before the end of the track). Thus, the fading out of stream A may be perceived before the volume of the track becomes too low for the fading out effect to be appreciated. Further, the longer duration of the fading out of stream A ($t_1'$ to $t_2$, rather than $t_1$ to $t_2$) may also increase the likelihood that the crossfade may be perceived.

Figure 5:
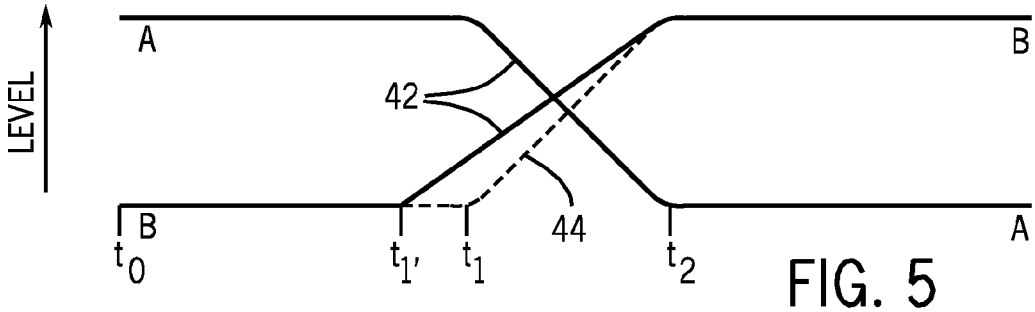

Likewise, another modification of crossfade duration may involve adjusting the point in time at which stream B is increased in level. As depicted in FIG. 5, the crossfading of streams A and B begins at time $t_1'$ when stream B begins to increase in level. Point $t_1'$ may occur some time before time $t_1$, where stream A begins to decrease in level. At $t_2$, stream A has ended or is reduced to the lowest level, and stream B is at the highest level. Thus, perceptibility of a crossfade effect may be increased if, for example, the volume of stream B near the beginning of the stream is low. For example, in such circumstances, unmodified crossfade effect may be less perceptible to a user if the volume of stream B during the first ten seconds is so low that an increase in level during that time has little effect on the output volume. By beginning the level increase of stream B earlier than $t_1$ (at $t_1'$), the fading in of stream B may be more noticeable during the fading out of stream A, increasing the perceptibility of the crossfade. As will be appreciated, the result achieved by the crossfade modifications of FIGS. 4 and 5 may also be achieved by extending the duration of the fade in or fade out of streams A and B by having one or more fade in and/or fade out endpoints later than $t_2$. For example, stream A may end or be reduced to the lowest level before stream B is played at the highest level, or stream B may be played at the highest level before stream A ends or is reduced to the lowest level.

Figure 6:
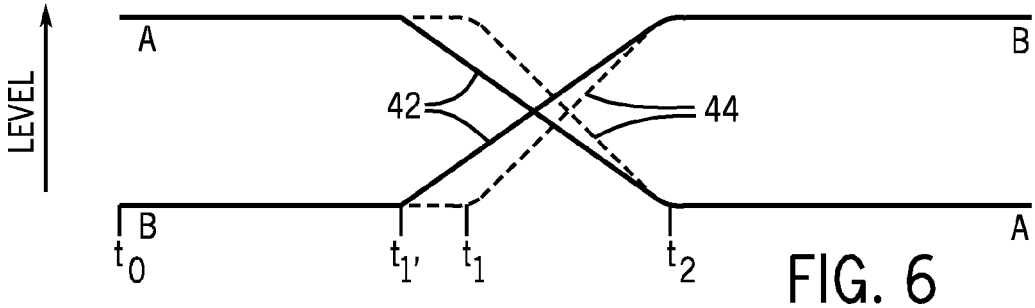

While the graphs in FIGS. 4 and 5 depict modifications of crossfades where either stream A is modified to begin prior to the unmodified fade in of stream B, or the fade in of stream B is modified to begin prior to the unmodified fade out of stream A, another crossfade modification, depicted in FIG. 6, may include both stream A fading out and stream B fading in sooner than usual. The beginning of this duration-modified crossfade ($t_1'$) may be earlier in time than the beginning of a duration-unmodified crossfade ($t_1$). At point $t_1'$, stream B begins to increase in level and stream A begins to decrease in level. Between $t_1'$ and $t_2$, the level of stream A is decreased, while the level of stream B is increased, crossfading the two streams A and B. At $t_2$, stream A has ended or is reduced to the lowest level, and stream B is at the highest level. Such an implementation of a modified crossfade where both streams A and B are crossfaded over a longer duration than is standard may be useful where, for example, the volume of stream A during the last ten seconds is low and the volume of stream B during the first ten seconds is low.

Figure 7:
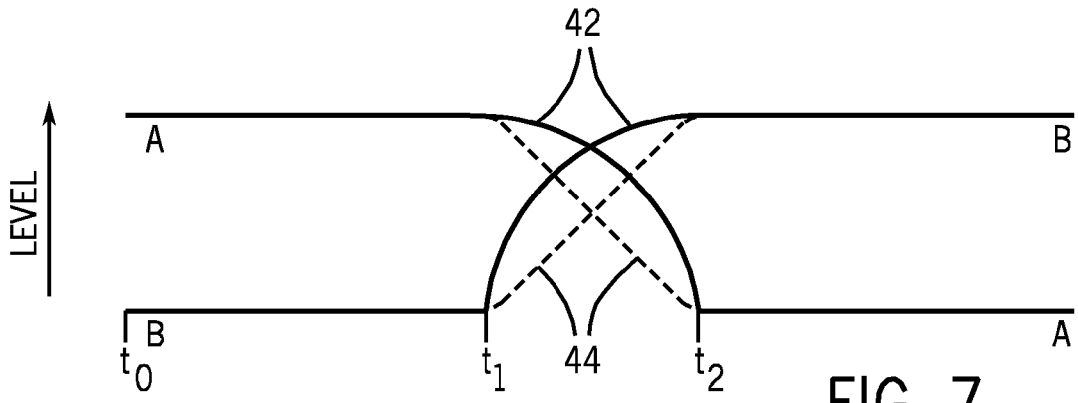

Other modifications of a crossfade may involve altering the shape of the crossfade curves such as from a linear curve or function to a curve or function that varies non-linearly over time. For example, the fade out of stream A and/or the fade in of stream B may not be linear. This means the level of streams A and/or B may decrease or increase at varying rates between $t_1$ and $t_2$. As illustrated in FIG. 7, stream A may decrease in level more slowly than if a linear fade out function were employed between $t_1$ and t, and stream B may increase in level more quickly than if a linear fade in function were employed between $t_1$ and $t_2$. For example, this modification may be implemented if the end portion of stream A has a lower volume or if the end portion of stream A has an already decreasing volume before any level adjustment. A linear fade out of stream A may not be perceivable or may too quickly decrease the output volume of stream A. Further, this modification may be implemented if the beginning portion of stream B has a lower volume, making a linear fade in of stream B less perceivable than a non-linear fade in that is modified to more quickly increase stream B's level.

Figure 8:
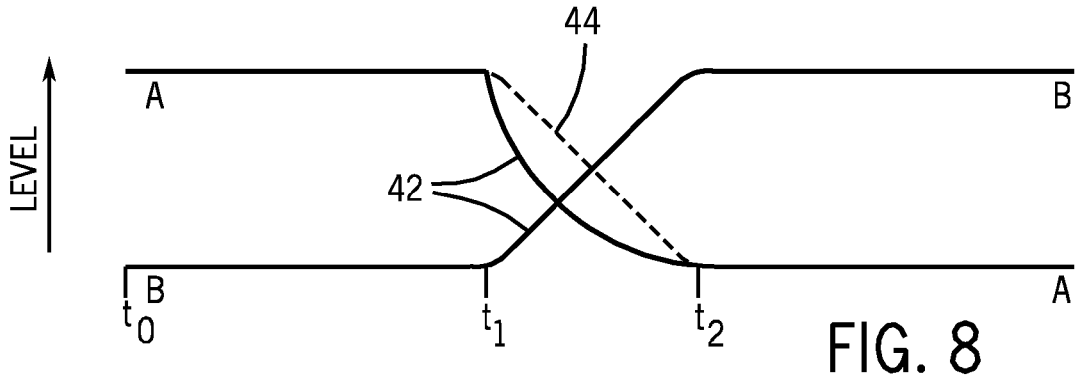

Though FIG. 7 depicts an embodiment of a crossfade modification where the curves of both stream A and stream B are altered, some modifications of a crossfade operation may involve altering the shape of only one stream. As depicted in FIG. 8, stream A may decrease in level more quickly than if a linear fade out function were employed, and stream B may fade in according to a default curve, for example, a linear increase, between $t_1$ and $t_2$. An example of when this modification may be implemented may be when the end portion of stream A has a higher volume, and an unmodified or linear fade out of stream A may not lower the level of stream A sufficiently for the fade in of stream B to be perceived. A quicker decrease in the level of stream A may enable a user to hear the increasing level of stream B, increasing the perceptibility of a crossfade.

Figure 9:
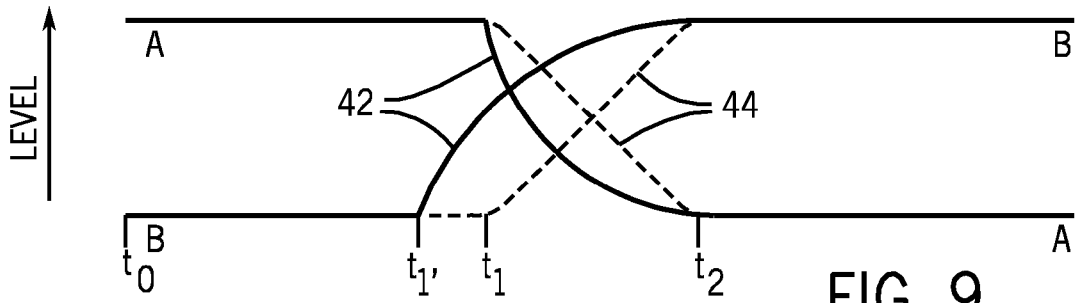

A crossfade operation may be modified to include any combination of duration and/or curve shape modifications. For example, FIG. 9 illustrates a modified crossfade where the crossfade of streams A and B begin at $t_1'$ when stream B begins to increase in level. Stream A may begin to decrease in level at $t_1$, and at $t_2$, stream A has ended or is reduced to the lowest level, and stream B is at the highest level. In this example, in addition to modifying the duration, the shape of the crossfade curves are also modified in the same crossfade operation. Between $t_1'$ and $t_2$, the level of stream B is increased more quickly than a linear increase, and between $t_1$ and $t_2$, the level of stream A is decreased more quickly than a linear decrease. The dotted segments 44 again represent an unmodified crossfade operation and provide a basis for comparison with the modified crossfade operation, represented by the solid lines 42.

Modification of a crossfade operation as described above may depend on the characteristics of the audio streams to be crossfaded. More specifically, the signals of audio streams may have different properties such as frequency, amplitude, etc., which may correspond to different characteristics during playback such as pitch, volume, etc. Certain characteristics of the audio streams may result in less perceptible crossfades, and in order to increase the perceptibility of a crossfade, different fade in and fade out modifications, such as the above described modifications to duration and shape of the fade in and/or fade out functions, may be applied to different audio streams. For example, a different fade out may be applied to the ending of an audio stream that is high in volume as opposed to the ending of an audio stream that is low in volume. The application of different crossfades may be implemented in the device 10 of FIG. 1.

Figure 10:
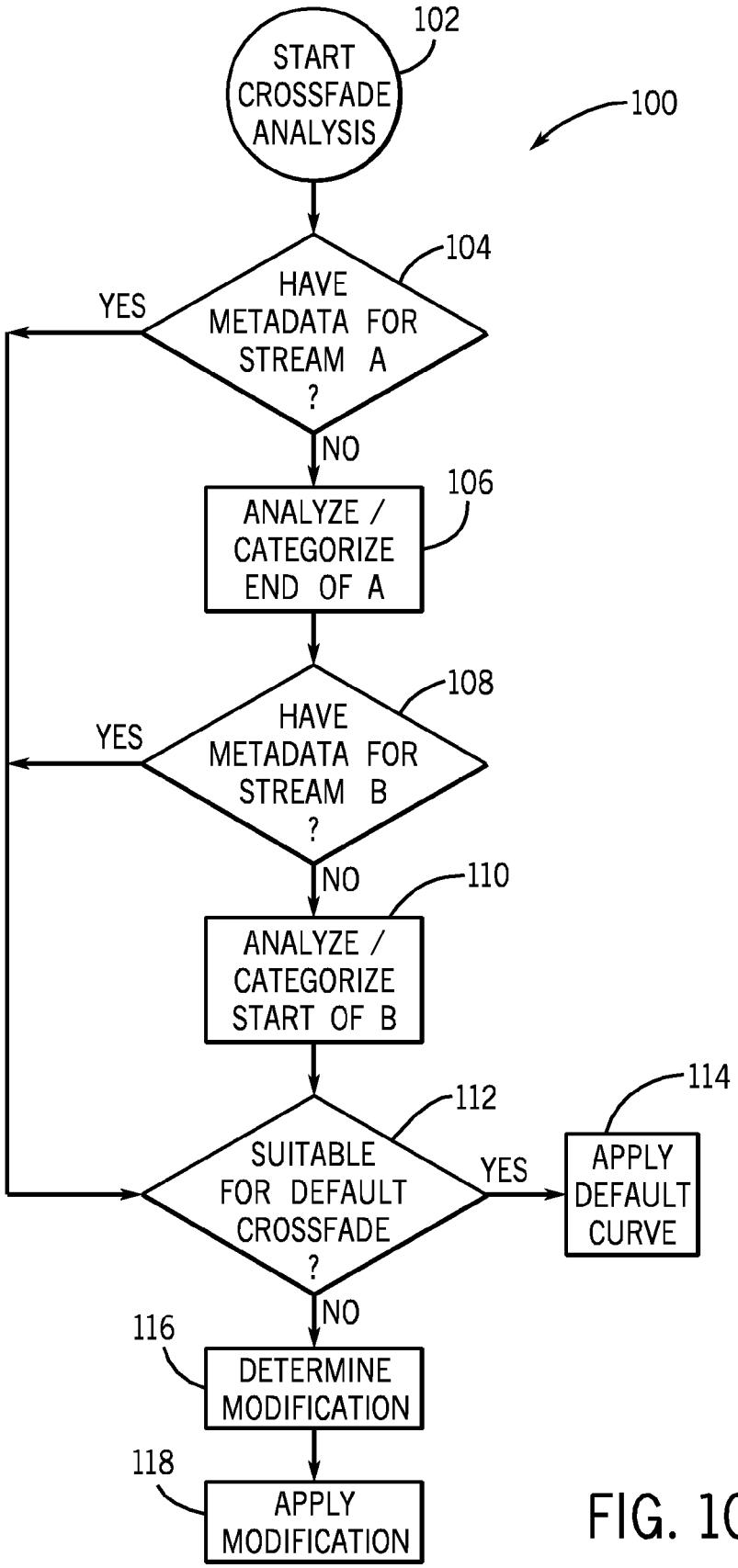
FIG. 10 is a flowchart of a process for controlling a crossfade operation in accordance with an embodiment of the present invention.

FIG. 10 depicts a flowchart of an example of a process for controlling a crossfade operation for stream A (an audio stream fading out) and stream B (an audio stream fading in) in accordance with an embodiment of the present invention. In an embodiment, a process 100 may be implemented in the audio processor 34, the processor(s) 22, or any other suitable processing component of the device 10 (FIG. 1). Initially, the process 100 may start the crossfade analysis (block 102), such as in response to an approaching end of an audio stream, selection of another audio stream (e.g., selection of another audio track), automatically, in response to a user request, or any other event likely to result in the end of playback of one audio file and the beginning of playback of another.

In one embodiment, the process 100 determines whether the device 10 has access to any metadata for stream A (block 104). In some embodiments, the metadata may include characteristics of the audio stream, including an energy profile of the audio stream or a fade in and/or fade out category assigned to the audio stream. As used herein, the energy of an audio stream signal may correspond to the playback volume or to other characteristics of the audio stream that may be perceived during playback. Also as used herein, the energy profile may refer to data describing an audio stream's energy as a function of time. Examples of such energy profiles may include, but are not limited to, an audio stream's energy over time, an audio stream's average power, or the root mean square (RMS) amplitude of an audio stream or any portion of an audio stream. A category assigned to an audio stream may refer to a quantitative or qualitative categorization based on the characteristics (such as the energy profile) of an audio stream or any portion of an audio stream. For example, the category of the audio stream may indicate that the stream has low, average, or high energy in any portion of the audio stream, or that the stream has increasing, steady, or decreasing energy in any portion of the audio stream. Based on the category of the audio stream, different fade in or fade out curves may be applied. By way of example, the fade out curve of stream A may be modified to have a longer duration (e.g., FIG. 4) because metadata for stream A indicates that stream A is categorized as having a low volume ending.

The metadata may be associated with a respective audio file, which may be stored in the storage 26, the memory 24, the dedicated memory 38, or any other suitable memory of the device 10 of FIG. 1. The metadata may have been encoded in the pre-processed audio file of an audio stream or stored in the device 10 after the processor(s) 22 or the audio processor 34 has analyzed an audio stream and created the metadata.

If the process 100 determines that the device 10 does not have access to any metadata for stream A (block 104), then the process 100 may perform an analysis on stream A to obtain information for the crossfade operation. The processor(s) 22 or audio processor 34 (or any other processing component of the device 10) may analyze the characteristics of the end of stream A (block 106). For example, the analysis may be of any function of a signal associated with stream A ("signal A"), including signal A's energy over time, which may refer to a property of signal A corresponding to the volume or some other characteristic of stream A during playback. The analysis may also be of any magnitude of signal A, including an average power value or an RMS amplitude, which may be a magnitude of all or any portion of signal A. Furthermore, in some embodiments, the process 100 may then categorize stream A (block 106) based on the analyses of the function and/or magnitude characteristics. As previously discussed, an audio stream may have low, average, or high volume in the ending or beginning, or a gradual or rapid decrease or increase in volume in the ending or beginning, and different fade out or fade in curves and/or durations may be applied based on the audio stream's categorization.

By way of example, in one embodiment, the process 100 may analyze the RMS amplitude of an end portion of stream A (block 106), which may correlate to an average output volume of the last ten seconds of stream A during playback. The categorization of stream A (block 106) may be made by comparing the RMS amplitude of the end portion of stream A to a threshold value, where if the RMS amplitude is beneath the threshold, stream A is categorized as having a low volume ending, and if the RMS amplitude is above the threshold, stream A is categorized as having a normal ending. The categorization of stream A (block 106) may also be made by comparing the RMS amplitude of the end portion of stream A to multiple thresholds, or ranges of values, where if the RMS amplitude is beneath a first threshold, stream A is categorized as having a low volume ending, if the RMS amplitude is between a first and second threshold, stream A is categorized as having a normal ending, and if the RMS amplitude is above a second threshold, stream A is categorized as having a high volume ending. Alternatively, the analyses results themselves, such as an RMS amplitude, may be provided as an input to a quantitative function that outputs parameters defining the duration and/or shape of a fade in or fade out operation for the respective audio stream.

In one embodiment, the analysis and/or categorization of stream A (block 106) may involve some comparison of any portion of signal A against one or more reference values or signals. The comparison may involve one or more signal processing techniques. For example, the process 100 may cross-correlate a portion of signal A with different signals representing different volume characteristics (low, normal, high, increasing, decreasing, etc.), or the process 100 may filter a portion of signal A to determine amplitude values, which may correspond to output volume at certain points in time during the playback of stream A. Thus, stream A may be determined to have a low, average, or high volume in the ending or beginning, or a gradual or rapid decrease or increase in volume in the ending or beginning, and different fade in or fade out curves may be applied to an audio stream based on its analysis and/or categorization.

If the process 100 determines that the device 10 does have access to metadata for stream A (block 104), then certain portions of the analysis or categorization of stream A (block 106) may not be necessary. The audio processor 34 or processor(s) 22 (or any other processing component of the device 10) may access the metadata (which includes characteristics of stream A, as described above) and use the encoded analysis and/or categorization to perform a crossfade operation.

Using the information on stream A, either from the analysis/categorization of stream A or from the metadata of stream A, the process 100 may determine whether stream A is suitable for a default crossfade (block 112). For example, the metadata may indicate that stream A has an energy profile suitable for a fade out operation using default parameters, or stream A may be analyzed and assigned to a category that is suitable for such a default fade out operation. The process 100 may then apply a default curve and duration (block 114) to fade out stream A. Conversely, the process 100 may determine that stream A is not suitable for a default crossfade (block 112). The metadata may indicate that stream A has low or high energy in the end portion of the stream, or after the analysis and/or categorization of stream A (block 106), stream A may be categorized as having a low or high ending volume. The process 100 may then determine a fade out operation using modified parameters that may be more suitable for stream A (block 116).

As previously discussed and depicted in FIGS. 4-9, the device 10 may apply a variety of modified fade out operations depending on the characteristics of stream A. For example, the fade out operation of stream A may be modified to have a longer duration (e.g., FIG. 4) because stream A is categorized (either in the metadata or by analysis by the process 100) as having a low volume ending. In addition, different modified fade out operations may be applied to stream A depending on the characteristics of stream B. For example, stream B may have a high starting volume, and stream A may be modified to fade out in a non-linear curve to increase the perceptibility of a crossfade relative to stream B.

The process 100 may select a pre-determined fade in or fade out operation based upon an analysis performed on the audio stream or on a category previously associated with the stream, or the process 100 may customize the fade in or fade out according to such an analysis or category of the audio streams. Once the process 100 selects or generates a modified crossfade curve (block 116) to fade out stream A, the process 100 applies the modification (block 118) and stream A is faded out according to a modified crossfade curve.

A similar process for applying a default (block 114) or a modified crossfade curve (block 118) may be conducted for stream B. The process 100 may first determine whether metadata is available for stream B (block 108). The determination of whether metadata is available for stream A (block 104) or for stream B (block 108) may be made simultaneously or in a different order, and the process 100 may find that metadata is available for both, neither, or one and not the other.

If metadata is not available for stream B, then the process 100 will analyze and/or categorize the start of stream B (block 110), which may be similar to the previously described analysis/categorization process of the end of stream A (block 106). Based on the analysis/categorization of stream B (block 110), the process 100 may determine whether stream B is suitable for a default crossfade (block 112), or alternatively, determine the appropriate crossfade modification to apply to stream B (block 116). Based on either the metadata for stream B or on the analysis/categorization of stream B (block 110), the process 100 may determine whether stream B is suitable for a default crossfade operation (block 112), and if so, apply a default fade in operation for stream B (block 114). Alternatively, the process 100 may determine the appropriate crossfade modification (block 116) and apply the modified curve to fade in stream B (block 118).

The process 100 depicts analysis/categorization for the end of stream A (block 106) and the beginning of stream B (block 110) as an example, because these categorizations are immediately relevant to the current crossfade operation. However, categorizing the end of stream A (block 106) and categorizing the beginning of stream B (block 110) may also include categorizing the beginning of stream A, the end of stream B, or any other portion of streams A and B. The results of the categorizations of streams A and B (blocks 106 and 110) may be stored in a suitable memory component of the device 10 in a look up table or as metadata which may be accessed in future crossfade operations.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method comprising:

analyzing first metadata associated with an ending audio track, wherein the first metadata indicates that an energy profile of the ending audio track is characterized as one of a plurality of audio energy categories, analyzing second metadata associated with a beginning audio track, wherein the second metadata indicates that an energy profile of the beginning audio track is characterized as one of the plurality of audio energy categories;

performing a crossfade operation on a media player based at least in part on the first metadata and the second metadata, wherein performing the crossfade operation comprises:

modifying a first default crossfade curve that corresponds to the ending audio track;

modifying a second default crossfade curve that corresponds to the beginning audio track; or any combination thereof, wherein modifying the first default crossfade curve or the second default crossfade curve comprises modifying a linear crossfade curve into a non-linear crossfade curve.

2. The method of claim 1, comprising analyzing a playback characteristic of the ending audio track or the beginning audio track to determine the first metadata or the second metadata.

3. The method of claim 2, wherein the playback characteristic comprises playback volume.

4. The method of claim 2, comprising determining the playback characteristic based upon an energy or energy profile over time of one or more signals corresponding to the ending audio track or the beginning audio track.

5. The method of claim 1, wherein the plurality of audio energy categories comprises:

an increasing energy category, a steady energy category, and a decreasing energy category; or a low energy category, an average energy category, and a high energy category.

6. A device comprising:

a storage structure physically encoding a plurality of executable routines, the routines comprising:

instructions to read first metadata associated with a first audio signal, wherein the first metadata indicates that an energy profile of an end portion of the first audio signal is characterized as one of a plurality of categories, wherein the plurality of categories comprises a low energy category, an average energy category, and a high energy category;

instructions to read second metadata associated with a second audio signal, wherein the second metadata indicates that an energy profile of a beginning portion of the second audio signal is characterized as one of the plurality of categories;

instructions to modify a first default crossfade curve associated with the end portion of the first audio signal during playback based at least in part on the first metadata;

instructions to modify a second default crossfade curve associated with the beginning portion of the second audio signal during playback based at least in part on the second metadata; and a processor capable of executing the routines stored on the storage structure.

7. The device of claim 6, wherein the instructions to modify the first default cross fade curve and the second default cross fade curve are configured to:

decrease a volume parameter associated with the first default crossfade curve according to a first nonlinear curve based at least in part on the first metadata; and increase a volume parameter associated with the second default crossfade curve according to a second nonlinear curve based at least in part on the second metadata.

8. A device comprising:

a storage structure physically encoding a plurality of executable routines, the routines comprising:

instructions to determine a first root mean square (RMS) value for only a terminal portion of a first audio signal and to determine a second RMS value for only an initial portion of a second audio signal;

instructions to categorize the terminal portion as one of a plurality of audio energy categories when the first RMS value is within a corresponding range of RMS values;

instructions to categorize the initial portion as one of the plurality of audio energy categories when the second RMS value is within a corresponding range of RMS values;

instructions to perform a crossfade operation on the first audio signal and the second audio signal, based at least in part on the categorization of the terminal portion and the categorization of the initial portion, wherein the instructions to perform the crossfade operation are configured to:

modify a first default crossfade curve associated with the terminal portion of the first audio signal;

modify a second default crossfade curve associated with the initial portion of the second audio signal; or any combination thereof; and a processor configured to execute the routines stored on the storage structure, wherein the plurality of audio energy categories comprises a low energy category, an average energy category, and a high energy category.

9. The device of claim 8, wherein the first RMS value, the second RMS value, the categorization of the terminal portion, the categorization of the initial portion, or any combination thereof are contained in metadata accessible by the device.

10. The device of claim 8, wherein the storage structure physically encoding a plurality of executable routines comprises:

instructions to store the first RMS value, the second RMS value, the categorization of the terminal portion, the categorization of the initial portion, or any combination thereof to the storage structure, wherein one or more characteristics of the crossfade operation are determined based on the stored first RMS value, the second stored RMS value, the stored categorization of the terminal portion, the stored categorization of the initial portion, or any combination thereof.

11. The device of claim 8, wherein the plurality of audio energy categories comprises an increasing energy category, a steady energy category, and a decreasing energy category.

12. A method comprising:

reading first metadata associated with a first audio track, wherein the first metadata indicates that an energy profile of the first audio track is characterized as one of a plurality of categories, wherein the plurality of categories comprises a low energy category, an average energy category, and a high energy category;

reading second metadata associated with a second audio track, wherein the second metadata indicates that an energy profile of the second audio track is characterized as one of the plurality of categories;

modifying a default fade-out curve associated with the first audio track and modifying a default fade-in curve associated with the second audio track based at least in part on the first metadata and the second metadata, wherein modifying the default fade-out curve comprises modifying a duration of the default fade-out curve, and wherein modifying the default fade-in curve comprises modifying a duration of the default fade-in curve.

13. The method of claim 12, wherein the instructions configured to modify the default fade-out curve or the default fade-in curve comprises modifying a linear curve into a non-linear curve.

14. The method of claim 12, wherein the first metadata and the second metadata indicate playback characteristics of an ending portion of the first audio track and playback characteristics of a beginning portion of the second audio track, respectively.

15. The method of claim 14, comprising:

analyzing the playback characteristics of the ending portion of the first audio track; and analyzing the playback characteristics of the beginning portion of the second audio track, wherein modifying the default fade-out curve is based at least in part on the analysis of playback characteristics of the ending portion of the first audio track, and wherein modifying the default fade-in curve is based at least in part on the analysis of playback characteristics of the beginning portion of the second audio track.

16. A non-transitory computer-readable medium embodying executable instructions that, when executed, implement a method comprising:

analyzing first metadata associated with an ending audio track, wherein the first metadata indicates that an energy profile of the ending audio track is characterized as one of a plurality of audio energy categories, analyzing second metadata associated with a beginning audio track, wherein the second metadata indicates that an energy profile of the beginning audio track is characterized as one of the plurality of audio energy categories;

performing a crossfade operation on a media player based at least in part on the first metadata and the second metadata, wherein performing the crossfade operation comprises:

modifying a first default crossfade curve that corresponds to the ending audio track;

modifying a second default crossfade curve that corresponds to the beginning audio track; or any combination thereof, wherein modifying the first default crossfade curve or the second default crossfade curve comprises modifying a linear crossfade curve into a non-linear crossfade curve.

17. The computer-readable medium of claim 16, wherein the method comprises analyzing a playback characteristic of the ending audio track or the beginning audio track to determine the first metadata or the second metadata.

18. The computer-readable medium of claim 17, wherein the playback characteristic comprises playback volume.

19. The computer-readable medium of claim 17, wherein the method comprises determining the playback characteristic based upon an energy or energy profile over time of one or more signals corresponding to the ending audio track or the beginning audio track.

20. The computer-readable medium of claim 16, wherein the plurality of audio energy categories comprises:

an increasing energy category, a steady energy category, and a decreasing energy category; or a low energy category, an average energy category, and a high energy category.

21. A non-transitory computer-readable medium embodying executable instructions that, when executed, implement a method comprising:

reading first metadata associated with a first audio track, wherein the first metadata indicates that an energy profile of the first audio track is characterized as one of a plurality of categories, wherein the plurality of categories comprises a low energy category, an average energy category, and a high energy category;

reading second metadata associated with a second audio track, wherein the second metadata indicates that an energy profile of the second audio track is characterized as one of the plurality of categories;

modifying a default fade-out curve associated with the first audio track and modifying a default fade-in curve associated with the second audio track based at least in part on the first metadata and the second metadata, wherein modifying the default fade-out curve comprises modifying a duration of the default fade-out curve, and wherein modifying the default fade-in curve comprises modifying a duration of the default fade-in curve.

22. The computer-readable medium of claim 21, wherein the instructions configured to modify the default fade-out curve or the default fade-in curve comprises modifying a linear curve into a nonlinear curve.

23. The computer-readable medium of claim 21, wherein the first metadata and the second metadata indicate playback characteristics of an ending portion of the first audio track and playback characteristics of a beginning portion of the second audio track, respectively.

24. The computer-readable medium of claim 23, wherein the method comprises:

analyzing the playback characteristics of the ending portion of the first audio track; and analyzing the playback characteristics of the beginning portion of the second audio track, wherein modifying the default fade-out curve is based at least in part on the analysis of playback characteristics of the ending portion of the first audio track, and wherein modifying the default fade-in curve is based at least in part on the analysis of playback characteristics of the beginning portion of the second audio track.

* * * * *